US008303359B2

(12) United States Patent
Matsuda et al.

(10) Patent No.: US 8,303,359 B2
(45) Date of Patent: Nov. 6, 2012

(54) OUTBOARD MOTOR

(75) Inventors: Yoshiyuki Matsuda, Wako (JP); Hajime Yoshimura, Wako (JP); Nobuchika Katagiri, Wako (JP); Masahide Shinokawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 188 days.

(21) Appl. No.: 12/949,156

(22) Filed: Nov. 18, 2010

(65) Prior Publication Data

US 2011/0124250 A1 May 26, 2011

(30) Foreign Application Priority Data

Nov. 24, 2009 (JP) ..... 2009-266537

(51) Int. Cl.
*B63H 20/14* (2006.01)

(52) U.S. Cl. ..... 440/75

(58) Field of Classification Search ..... 440/75
See application file for complete search history.

(56) References Cited

U.S. PATENT DOCUMENTS

| | | | | |
|---|---|---|---|---|
| 5,924,901 | A * | 7/1999 | Takahashi et al. | 440/88 L |
| 8,047,885 | B2 * | 11/2011 | Nakamura et al. | 440/75 |
| 2001/0044245 | A1 * | 11/2001 | Nakata et al. | 440/89 |
| 2009/0176420 | A1 * | 7/2009 | Fukuoka et al. | 440/88 L |

FOREIGN PATENT DOCUMENTS

| | | |
|---|---|---|
| CA | 997628 | 9/1976 |
| JP | 2009-185972 | 8/2009 |

* cited by examiner

*Primary Examiner* — Stephen Avila
(74) *Attorney, Agent, or Firm* — Rankin, Hill & Clark LLP

(57) ABSTRACT

An outboard motor includes a transmission mechanism mounted between an output shaft of an engine and a propeller drive shaft. The transmission mechanism includes a clutch. An oil pump for generating a hydraulic pressure so as to switch the clutch is disposed underneath a lowermost one of transmission gears closely thereto. An oil pan is disposed underneath the oil pump and is placed inside an exhaust channel of a gear case.

4 Claims, 5 Drawing Sheets

OUTBOARD MOTOR

FIELD OF THE INVENTION

The present invention relates to an outboard motor having a transmission mechanism which is disposed between an output shaft of an engine and a propeller drive shaft.

BACKGROUND OF THE INVENTION

This type of outboard motor equipped with a transmission mechanism is known in the industry, as disclosed in Japanese Patent Application Laid-Open Publication No. 2009-185972 (JP 2009-185972 A).

FIG. 5 hereof shows the outboard motor disclosed in JP 2009-185972 A.

As can be seen in FIG. 5, an outboard motor 200 is attached to a hull 202 by a swivel arm 201. A vertical engine 203 is disposed in an upper part of the outboard motor 200. Power from the engine 203 is transmitted to a transmission mechanism 206 via an input shaft 205 connected to a crankshaft 204. The power transmitted to the transmission mechanism 206 is transmitted to a propeller 209 via a propeller drive shaft 208 accommodated in a gear case 207.

Exhaust gas generated by the engine 203 is discharged to the exterior through an exhaust channel 211 provided inside a case 210. A lubricating oil pump 212 is disposed in an upper part of the transmission mechanism 206. The transmission mechanism 206 is disposed above the gear case 207.

An oil pan is usually disposed underneath the transmission mechanism 206. The oil used to lubricate the transmission mechanism 206 is recovered in the oil pan, and can be reused for lubrication by the oil pump 212.

However, the oil pump 212 is disposed in the upper part of the transmission mechanism 206 in the outboard motor shown in FIG. 5, making it necessary to raise the level of the oil in order for the oil to be drawn upward, and generating a certain amount of resistance. There has been a demand in recent years for further improvement in the power transmission efficiency of the transmission mechanism. It is accordingly desirable to increase the power transmission efficiency of the transmission mechanism while maintaining the lubrication performance.

In addition, the oil pump 212 and the oil pan are disposed separately from the exhaust channel 211 and are placed above the gear case 207. Having these components disposed one above the other raises the center of gravity of the outboard motor.

SUMMARY OF THE INVENTION

It is an object of the present invention to provide an outboard motor in which the power transmission efficiency of the transmission mechanism is increased and the center of gravity of the outboard motor is lowered while the transmission mechanism is adequately lubricated.

According to one aspect of the present invention, there is provided an outboard motor comprising an output shaft of an engine, a propeller drive shaft and a transmission mechanism mounted between the output shaft and the propeller drive shaft and provided with a vertical gear-shifting shaft, wherein the transmission mechanism has a plurality of transmission gears and a clutch rotatable together with the gear-shifting shaft for switching between combinations of the transmission gears, wherein the clutch is switched by a hydraulic pressure of oil supplied from an oil pump, the oil pump is disposed underneath a lowermost one of the transmission gears closely thereto, for suctioning oil accumulated in an oil pan, the oil pan is disposed underneath the oil pump.

In the present invention, the oil pan is disposed in the lowermost part, the oil in the oil pan is at a low level, and the transmission gears of the transmission mechanism, the clutch, and the like do not come into contact with the oil in the oil pan at all. It is therefore possible to reduce the agitation resistance of the oil and to increase the power transmission efficiency of the transmission mechanism while adequately lubricating the transmission mechanism. In addition, the center of gravity of the outboard motor can be lowered because the oil pump and the oil pan are disposed underneath the transmission mechanism.

Furthermore, since the oil pan is disposed below the transmission mechanism, the oil that has lubricated the transmission mechanism returns to the oil pan by natural dripping. Accordingly, the oil that has been used in lubrication can be efficiently recovered in the oil pan.

Also, since the oil pump is disposed directly above the oil pan, the suction pipe from the oil pan to the oil pump can be shortened, and the suction resistance of the oil pump can be reduced as a result.

Preferably, the propeller drive shaft is accommodated in the gear case. An exhaust channel for passing exhaust from the engine may be provided inside the gear case. The oil pan may be disposed inside the exhaust channel.

Having the oil pan thus disposed inside the exhaust channel of the gear case, and the oil pan being placed lower, allows the transmission mechanism and the oil pump to be placed low as well, and the center of gravity of the outboard motor can therefore be lowered even further. In addition, utilizing the space of the exhaust channel allows the entire outboard motor to be reduced in size. Furthermore, cooling water also passes through the exhaust channel, allowing the exhaust mechanism to be cooled as well.

The empty space inside the exhaust channel is efficiently used to accommodate the oil pan, dispensing with the need to provide a separate space for the oil pan. The outboard motor equipped with the transmission mechanism and the oil pan can therefore be reduced in size.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
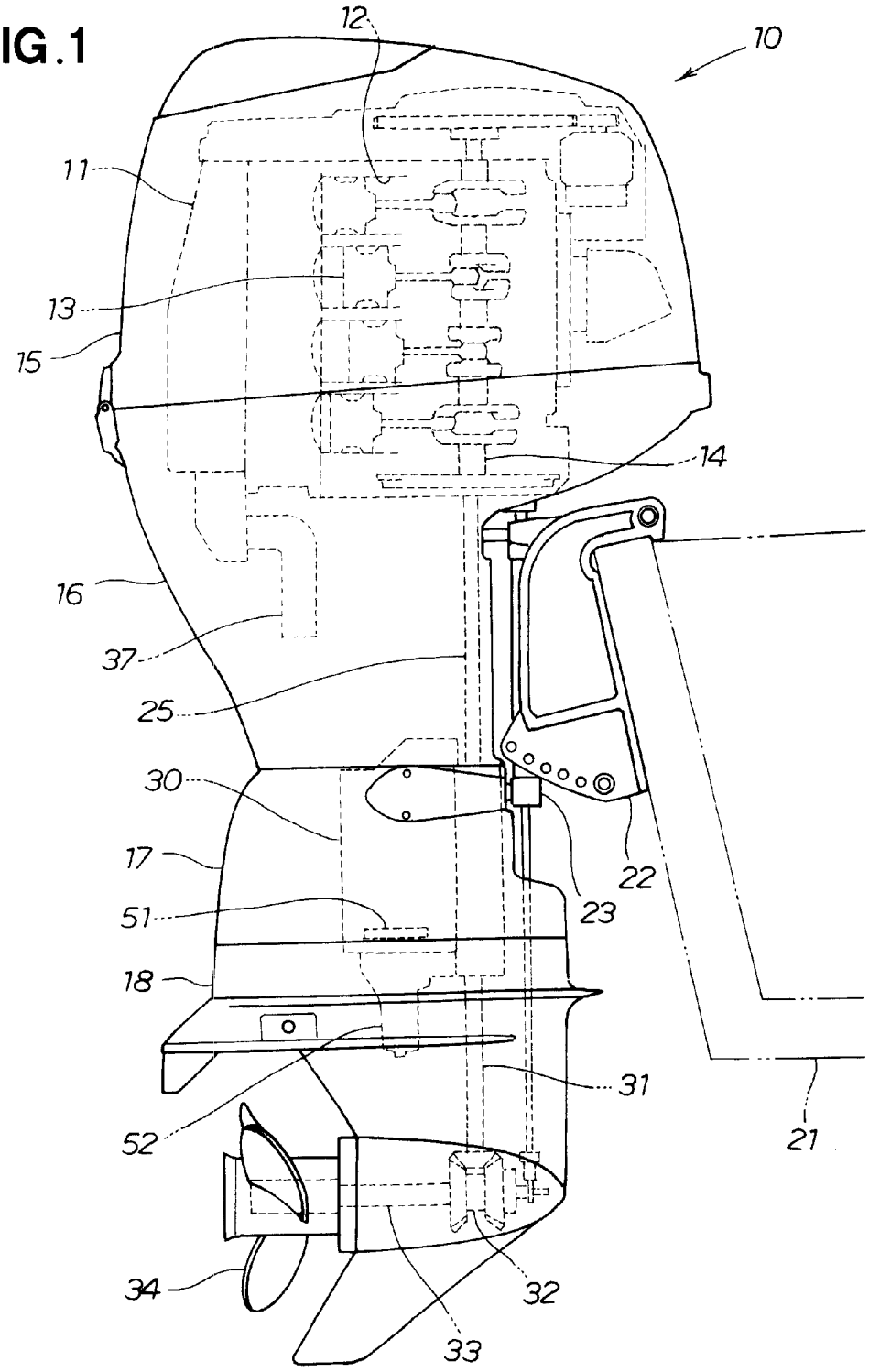
FIG. 1 is a side elevational view showing an outboard motor according to an embodiment of the present embodiment.

As shown in FIG. 1, an engine 11 is provided in an upper part of an outboard motor 10. The engine 11 is a vertical engine in which cylinders 12 and pistons 13 are oriented horizontally, and a crankshaft 14 and a camshaft are oriented vertically.

The exterior of the outboard motor 10 includes an upper engine cover 15 for covering an upper part of the engine 11, a lower engine cover 16 provided beneath the upper engine cover 15, an extension case 17 provided beneath the lower engine cover 16, and a gear case 18 provided beneath the extension case 17.

The outboard motor 10 is attached via a swivel shaft 23 to a stern bracket 22 linked to a hull 21, and is thereby allowed to pivot about the swivel shaft 23 to a predetermined maximum angle of steering.

The power from the engine 11 is transmitted to a transmission mechanism 30 via an output shaft 25 connected to the crankshaft 14. The power transmitted to the transmission mechanism 30 is then transmitted to a propeller 34 via a drive shaft 31, a pair of dog clutches 32, and a propeller drive shaft 33. By switching between the pair of dog clutches 32, the propeller 34 can be switched between forward rotation and reverse rotation to obtain forward or rearward propulsion force. The propeller 34 is rotatably provided to the gear case 18.

Figure 2:
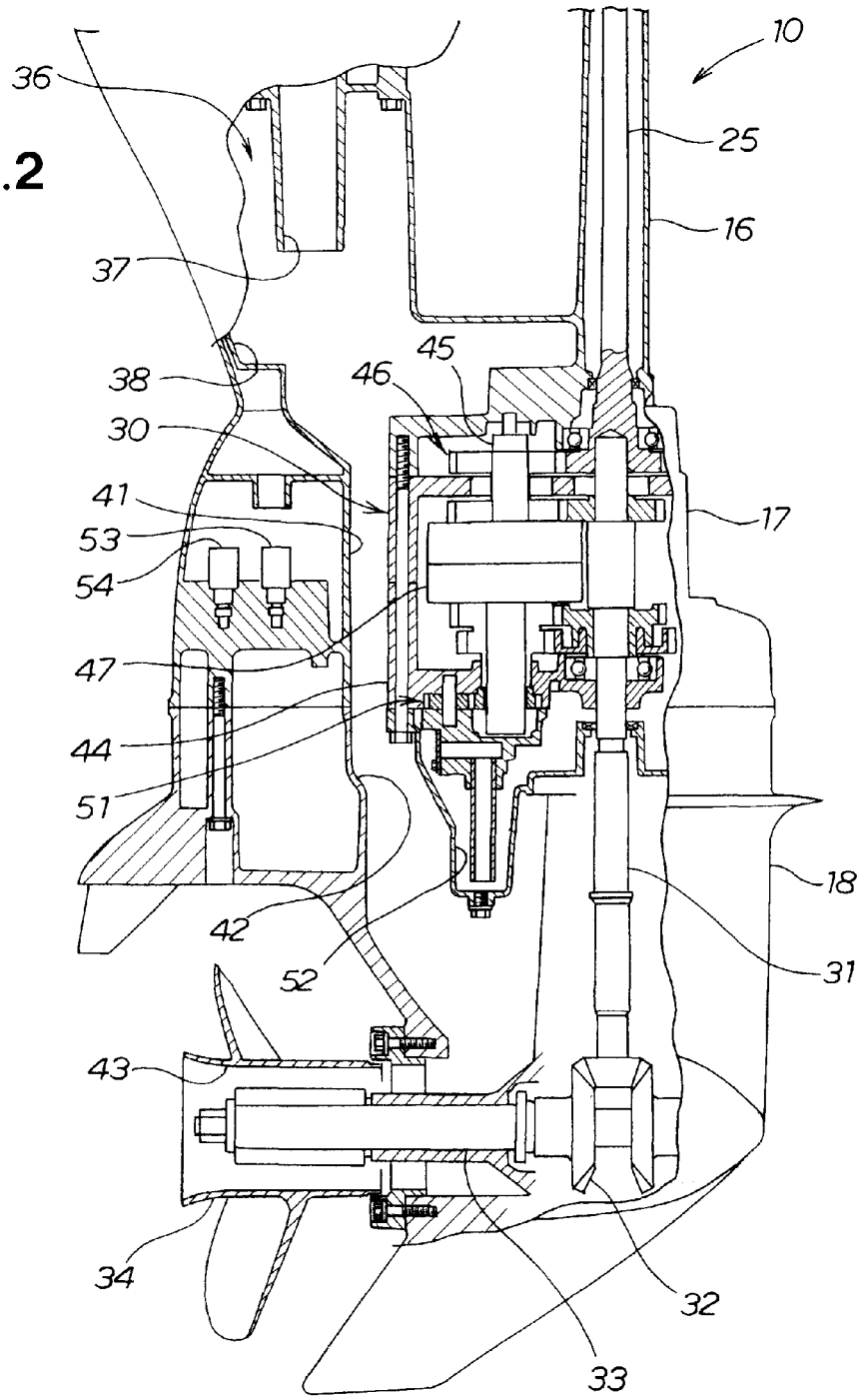
FIG. 2 is a partial cross-sectional view showing an exhaust channel.

As shown in FIG. 2, an exhaust-guiding channel 36 for discharging exhaust generated by the engine 11 to the exterior is provided beneath the engine 11 (FIG. 1).

The exhaust-guiding channel 36 includes an engine-side exhaust pipe 37 connected to an exhaust manifold of the engine 11 and disposed close to the engine 11, a lower engine cover exhaust channel 38 provided inside the lower engine cover 16, an extension cover exhaust channel 41 provided inside the extension cover 17, an exhaust channel 42 provided inside the gear case 18, and a cylindrical exhaust port 43 provided to the center of the propeller 34.

The transmission mechanism 30 includes a case unit 44, a gear-shifting shaft 45 provided vertically to the case unit 44, a plurality of transmission gears 46 provided to the gear-shifting shaft 45, and a clutch 47 for switching between combinations of the transmission gears 46. The clutch rotates together with the gear-shifting shaft 45.

An oil pump 51 for the clutch 47 is disposed underneath the lowermost one of transmission gears 46 closely to the latter, and an oil pan 52 is disposed underneath the oil pump 51. The oil pan 52 is disposed within the exhaust channel 42 of the gear case 18.

The clutch 47 is switched by the hydraulic pressure of the oil supplied from the oil pump 51. Specifically, the hydraulic switching is performed by first and second solenoid valves 53, 54.

The transmission mechanism 30 will next be described in detail with reference to FIG. 3.

The case unit 44 of the transmission mechanism 30 includes a lower case 55, an upper case 56, and a lid 57. The lower case 55 and the upper case 56 are secured to the oil pan 52 and the lid 57 by a bolt 58.

The output shaft 25 is rotatably supported in the case unit 44 by a bearing 61. The lowermost end of the output shaft 25 is provided with a drive gear 62.

The gear-shifting shaft 45 is rotatably supported in the case unit 44 by bearings 63, 64. A driven gear 65 is provided to an upper end of the gear-shifting shaft 45 so as to rotate integrally with the gear-shifting shaft 45. A first speed gear 66 integrally formed with the gear-shifting shaft 45 is provided to a lower part of the gear-shifting shaft 45.

A second speed gear 67 and a third speed gear 68 are also provided to the gear-shifting shaft 45 so as to be capable of relative rotation. The clutch 47 is further provided to the gear-shifting shaft 45. The clutch 47 includes a vertically oriented upper clutch 71 and a vertically oriented lower clutch 72. A clutch case 73 for accommodating the clutch 47 includes an upper clutch case 74 for accommodating the upper clutch 71, and a lower clutch case 75 for accommodating the lower clutch 72. The upper clutch case 74 and the lower clutch case 75 are fixed on the gear-shifting shaft 45.

The upper clutch case 74 is a cylindrical member that is open at the top and closed at the bottom. A discharge hole 76 for the oil used in lubrication is provided to the lowermost part of the upper clutch case 74. In other words, the discharge hole 76 is formed in the outward radial direction of the bottom part of the upper clutch case 74. Oil that has entered the upper clutch case 74 from above can thereby be rapidly discharged through the discharge hole 76. There may be one or a plurality of discharge holes 76.

An inner clutch plate 77 is fixed to the third speed gear 68 in the upper clutch 71. An outer clutch plate 78 is provided to the upper clutch case 74 so as to be able to move up and down and to rotate integrally with the upper clutch case 74. The outer clutch plate 78 is urged by a spring 81 in a direction in which there is no contact with the inner clutch plate 77.

When the outer clutch plate 78 is lifted by the hydraulic pressure, the outer clutch plate 78 comes into contact with the inner clutch plate 77, and the third speed gear 68 rotates together with the gear-shifting shaft 45. With the lower clutch 72 as well, the second speed gear 67 rotates together with the gear-shifting shaft 45 in the same manner. The first speed gear 66 has the least number of teeth, and the number of teeth increases in the second speed gear 67 and then again in the third speed gear 68.

The drive shaft 31 is supported on the output shaft 25 via the bearing 82, so as to be capable of relative rotation, and is also rotatably supported on the case unit 44 by the bearing 83. A third driven gear 84 in a meshing engagement with the third speed gear 68 is provided to an upper part of the drive shaft 31. A second driven gear 85 in a meshing engagement with the second speed gear 67 is provided to a lower part of the drive shaft 31. A first driven gear 87 is provided beneath the second driven gear 85 via a one-way clutch 86 so as to mesh with the first speed gear 66.

The one-way clutch 86 is thereby engaged and the first driven gear 87 rotates at a low speed when the upper clutch 71 and the lower clutch 72 are both released.

The second driven gear 85 rotates at an intermediate speed when the lower clutch 72 alone is engaged. The first driven gear 87 also rotates at this time, but since the second driven gear 85 rotates faster, the one-way clutch 86 runs at idle.

The third driven gear 84 rotates at a high speed when the upper clutch 71 alone is engaged.

The oil accumulated in the oil pan 52 is suctioned by the oil pump 51 through a strainer 88 and is supplied to the clutch 47 or the like through a lubricating oil path 91. The oil pump 51 is used both for switching the clutch 47 and for oil lubrication.

The transmission gears 46 include the first through third speed gears 66, 67, 68, as well as the first through third driven gears 87, 85, 84.

The operation of the above-described outboard motor 10 will now be described.

Figure 4:
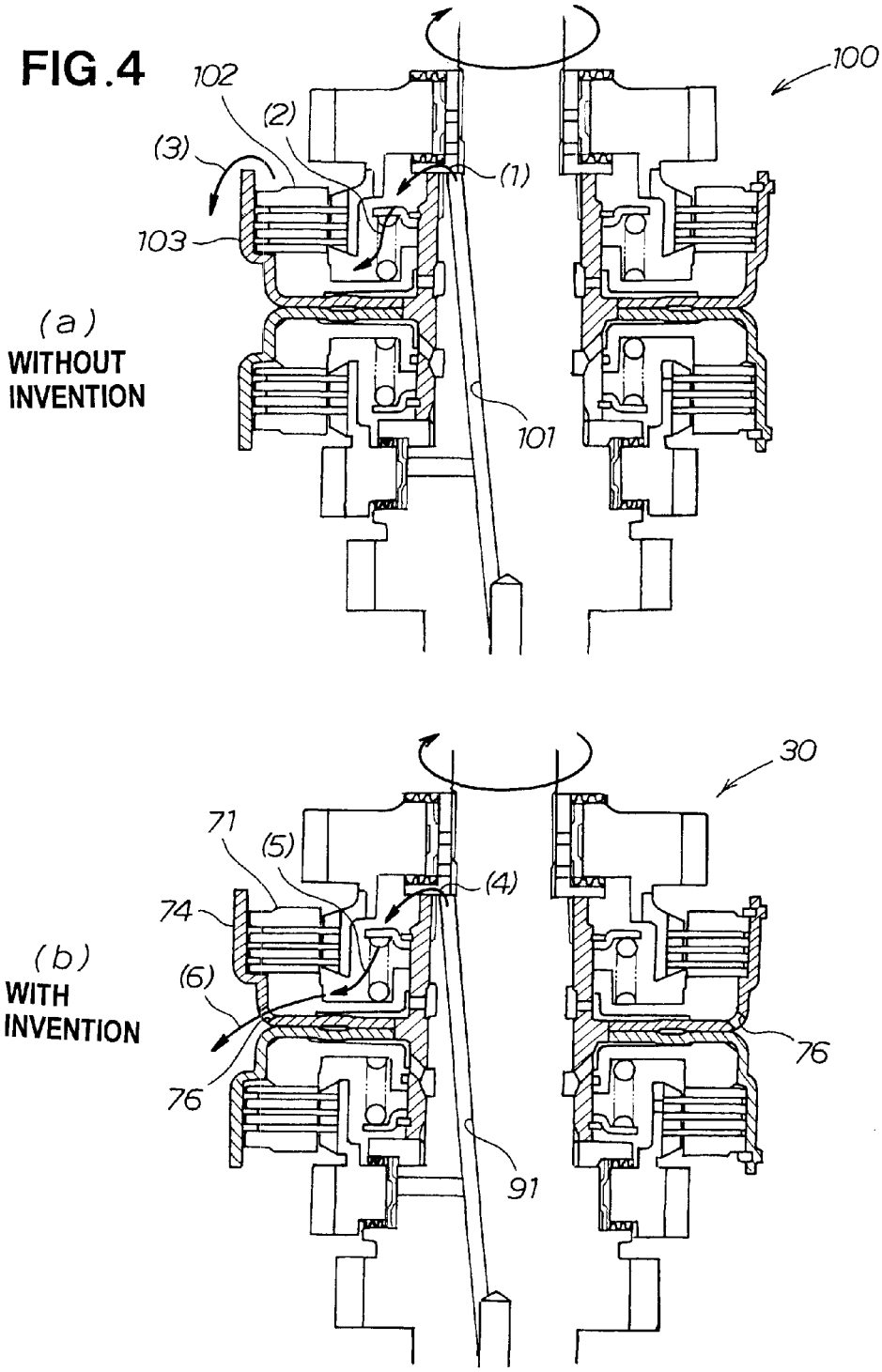
FIG. 4 illustrates an operation of a transmission mechanism with the invention as compared to an operation of a transmission mechanism without the invention.
Figure 5:
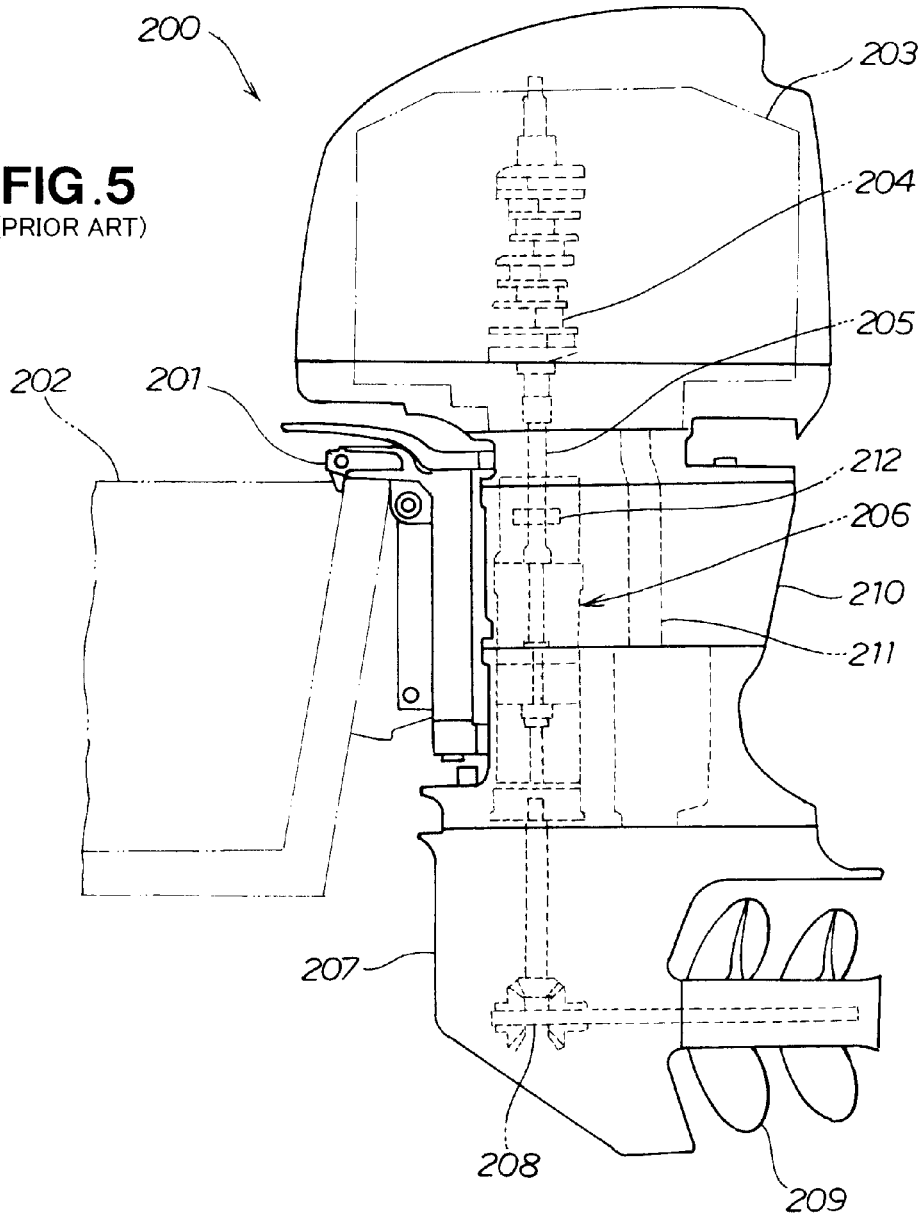
FIG.5 (PRIOR ART)
FIG. 5 is a side elevational view showing a conventional outboard motor.

FIG. 4(*a*) shows a comparative example in which a discharge hole is not provided to an upper clutch case 103. In a transmission mechanism 100, lubricating oil is supplied to an upper clutch 102 through a lubricating oil path 101, as shown by arrow (1). The upper clutch 102 is lubricated by oil sprayed from above. The oil supplied for lubrication accumulates inside the upper clutch case 103 as shown by arrow (2), and is discharged from an upper end part of the upper clutch case 103 as shown by arrow (3). However, the rotation of the upper clutch 102 experiences resistance because of the oil accumulating in the upper clutch case 103 in the transmission mechanism 100 of the comparative example.

In the embodiment shown in FIG. 4(*b*), the lubricating oil in the transmission mechanism 30 is supplied to the upper clutch 71 through the lubricating oil path 91, as shown by arrow (4). The upper clutch 71 is lubricated by the oil sprayed from above. The oil supplied for lubrication flows to the bottom of the upper clutch case 74 as shown by arrow (5), and is discharged through the discharge hole 76 as shown by arrow (6).

The discharge hole 76 is provided to the lowermost part of the upper clutch case 74 on the exterior thereof, allowing oil to be discharged even faster using the centrifugal force of the upper clutch case 74. Furthermore, since oil does not accumulate in the upper clutch case 74, resistance in the upper clutch 71 can be reduced and the power transmission efficiency increased.

Figure 3:
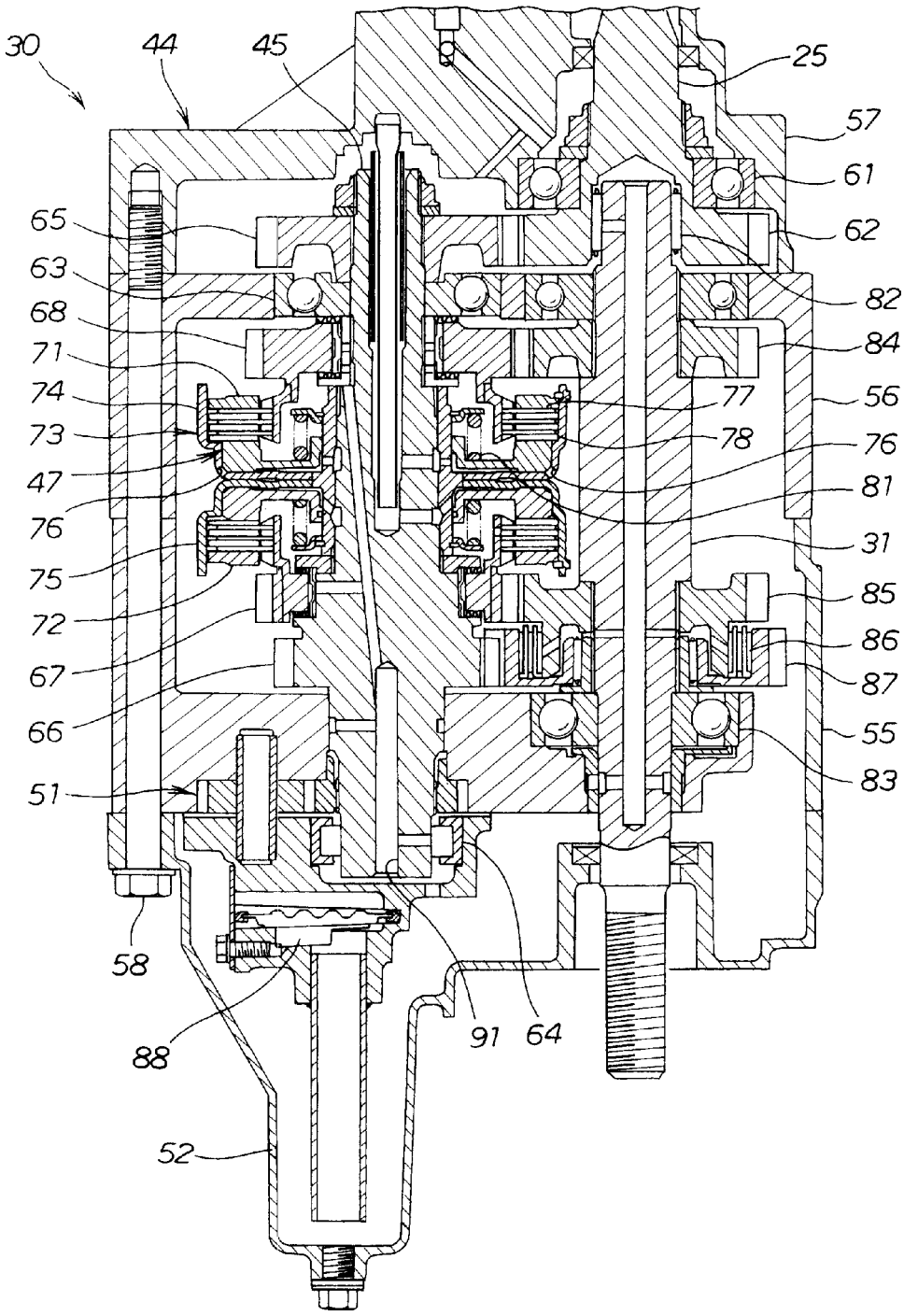
FIG. 3 is a cross-sectional view showing a transmission mechanism.

As shown in FIGS. 1 to 3 above, the outboard motor 10 in which a transmission mechanism 30 having a vertical gear-shifting shaft 45 is mounted between the output shaft 25 of the engine 11 and the propeller drive shaft 33 is configured so that the transmission mechanism 30 includes a plurality of transmission gears 46 and a clutch 47 for switching between combinations of the transmission gears 46. The clutch rotates together with the gear-shifting shaft 45. The clutch 47 is switched by the hydraulic pressure of the oil supplied from an oil pump 51. The oil pump 51 is disposed underneath the lowermost one of the transmission gears 46 closely thereto, for suctioning oil that has accumulated in an oil pan 52. The oil pan 52 is disposed underneath the oil pump 51.

With this arrangement, the oil pan 52 is disposed in the lowermost part; the oil in the oil pan 52 is at a low level; and the transmission gears 46 of the transmission mechanism 30, the clutch 47, and the like do not come into contact with the oil in the oil pan 52 at all. It is therefore possible to reduce the agitation resistance of the oil and to increase the power transmission efficiency of the transmission mechanism 30 while adequately lubricating the transmission mechanism 30. In addition, the center of gravity of the outboard motor 10 can be lowered because the oil pump 51 and the oil pan 52 are disposed underneath the transmission mechanism 30.

Since the oil pan 52 is disposed below the transmission mechanism 30, the oil that has lubricated the transmission mechanism 30 returns to the oil pan 52 by natural dripping. Accordingly, the oil that has been used in lubrication can be efficiently recovered in the oil pan 52.

Furthermore, the oil pump 51 is disposed directly above the oil pan 52, making it possible to reduce the length of the suction pipe leading from the oil pan 52 to the oil pump 51. As a result, the suction resistance of the oil pump 51 can be reduced.

As shown in FIGS. 1 to 3 above, the exhaust channel 42 for passing the exhaust from the engine 11 is provided inside the gear case 18 in which the propeller drive shaft 33 is accommodated, and the oil pan 52 is disposed inside the exhaust channel 42.

With this configuration, the transmission mechanism 30 and the oil pump 51 can be placed low by lowering the position of the oil pan 52, and the center of gravity of the outboard motor 10 can therefore be lowered even further. In addition, utilizing the space in the exhaust channel 42 allows the entire outboard motor 10 to be reduced in size. Furthermore, cooling water also passes through the exhaust channel 42, allowing the exhaust mechanism to be cooled as well.

The empty space inside the exhaust channel 42 is efficiently used to accommodate the oil pan 52, dispensing with the need to provide a separate space for the oil pan 52. The outboard motor 10 equipped with the transmission mechanism 30 and the oil pan 52 can therefore be reduced in size.

The present invention was used in an outboard motor 10 equipped with a three-speed transmission mechanism 30, but may also be used in an outboard motor equipped with a speed transmission mechanism having four speeds or another number of speeds.

The present invention is suitable for use in an outboard motor in which a transmission mechanism is mounted between the output shaft of the engine and the propeller drive shaft.

Obviously, various minor changes and modifications of the present invention are possible in light of the above teaching. It is therefore to be understood that within the scope of the appended claims the invention may be practiced otherwise than as specifically described.

What is claimed is:

1. An outboard motor comprising:

an output shaft of an engine;

a propeller drive shaft; and a transmission mechanism disposed between the output shaft and the propeller drive shaft and having a vertical gear-shifting shaft, wherein the gear-shifting shaft is parallel to, but laterally offset from, said output shaft and said drive shaft;

wherein the transmission mechanism includes a plurality of transmission gears and a clutch rotatable together with the gear-shifting shaft for switching between combinations of the transmission gears, wherein the switching of the clutch is effected by a hydraulic pressure of oil supplied to the clutch from an oil pump, the oil pump is disposed at a location underneath a lowermost one of the transmission gears closely thereto and laterally spaced from said drive shaft, for suctioning oil accumulated in an oil pan, and the oil pan is disposed underneath the oil pump and laterally spaced from said drive shaft.

2. The outboard motor of claim 1, wherein the propeller drive shaft is accommodated in a gear case, an exhaust channel for passing exhaust from the engine is provided inside the gear case, and the oil pan is disposed inside the exhaust channel.

3. The outboard motor of claim 1, wherein the clutch includes a upper clutch case holding an upper clutch and a lower clutch case holding a lower clutch, said upper and lower clutch cases being fixed on the gear-shifting shaft, oil from the oil pump is supplied to the upper clutch via a lubricating oil path, and wherein the upper clutch case defines a discharge hole at a lower outer portion thereof through which lubricating oil is discharged from the upper clutch case.

4. The outboard motor of claim 3, wherein the propeller drive shaft is accommodated in a gear case, and an exhaust channel for passing exhaust from the engine is provided inside the gear case, and the oil pan is disposed inside the exhaust channel.

* * * * *